US008829430B2

(12) United States Patent
Ledford, Jr.

(10) Patent No.: US 8,829,430 B2
(45) Date of Patent: Sep. 9, 2014

(54) PULSED MASS CALIBRATION IN TIME-OF-FLIGHT MASS SPECTROMETRY

(75) Inventor: Edward B. Ledford, Jr., Houston, TX (US)

(73) Assignee: Zoex Corporation, Houston, TX (US)

( * ) Notice: Subject to any disclaimer, the term of this patent is extended or adjusted under 35 U.S.C. 154(b) by 115 days.

(21) Appl. No.: 13/581,160

(22) PCT Filed: Feb. 25, 2011

(86) PCT No.: PCT/US2011/026239

§ 371 (c)(1), (2), (4) Date: Dec. 3, 2012

(87) PCT Pub. No.: WO2011/106640

PCT Pub. Date: Sep. 1, 2011

(65) Prior Publication Data

US 2013/0075598 A1 Mar. 28, 2013

Related U.S. Application Data

(60) Provisional application No. 61/308,519, filed on Feb. 26, 2010.

(51) Int. Cl.
*H01J 49/40* (2006.01)

(52) U.S. Cl.
USPC ..... 250/288; 250/281; 250/282; 250/287; 702/22; 702/27; 702/28

(58) Field of Classification Search
USPC ..... 250/281, 282, 287, 288; 702/22, 27, 28
See application file for complete search history.

(56) References Cited

U.S. PATENT DOCUMENTS

| | | | | |
|---|---|---|---|---|
| 5,703,360 | A * | 12/1997 | Fischer et al. | 250/288 |
| 7,071,463 | B2 | 7/2006 | Bowdler | |
| 7,315,020 | B2 | 1/2008 | Park et al. | |
| 2006/0023808 | A1 | 2/2006 | Hajivandi et al. | |
| 2008/0067356 | A1 | 3/2008 | Goodley et al. | |
| 2011/0172115 | A1* | 7/2011 | Thompson | 506/9 |

OTHER PUBLICATIONS

Notification Concerning Transmittal of International Preliminary Report on Patentability, Form PCT/IB/326, dated Sep. 7, 2012, from PCT/US2011/026239 (1 page).
International Preliminary Report on Patentability, Form PCT/IB/373, dated Aug. 28, 2012, from PCT/US2011/026239 (4 pages).
International Search Report, Form PCT/ISA/210, dated Nov. 3, 2011, transmitted with Form PCT/ISA/220, from PCT/US2011/026239.

(Continued)

*Primary Examiner* — Nicole Ippolito
(74) *Attorney, Agent, or Firm* — Kilyk & Bowersox, P.L.L.C.

(57) ABSTRACT

A method is provided for calibrating mass-to-charge ratio measurements obtained from a time-of-flight mass spectrometer used as a detector for a chromatographic system. The method can include introducing a calibrant material into the time-of-flight mass spectrometer after a sample is introduced to the chromatographic system, but before the analysis of the sample is complete, such that calibrant material and sample material are not present at the ion source of the mass spectrometer, contemporaneously. The method can include acquiring a multiplicity of mass spectra of the calibrant material during an analytical run, and in some embodiments, calculating a multiplicity of mass calibrations on the basis of mass spectra obtained from the calibrant material introduced during the analytical run.

17 Claims, 8 Drawing Sheets

(56) References Cited

OTHER PUBLICATIONS

Notification of the Transmittal of the International Search Report and the Written Opinion of the International Searching Authority, or the Declaration, Form PCT/ISA/220, dated Nov. 3, 2011, from PCT/US2011/026239.
Written Opinion of the International Searching Authority, Form PCT/ISA/237, dated Nov. 3, 2011, transmitted with Form PCT/ISA/220, from PCT/US2011/026239.

* cited by examiner

PULSED MASS CALIBRATION IN TIME-OF-FLIGHT MASS SPECTROMETRY

FIELD

This invention relates to high resolution time-of-flight mass spectrometry (HRTOFMS), and more particularly, to the art of calibrating the mass scale of a HRTOFMS used as the detector of a chromatographic separator.

BACKGROUND

Time-of-flight mass spectrometers are used as detectors for chromatographic separators, for example, in liquid chromatography (LC), gas chromatography (GC), and comprehensive two-dimensional chromatography (GC×GC). It is necessary to calibrate the mass scale or mass-to-charge scale of high resolution time-of-flight mass spectrometers for the purpose of accurate measurement of mass-to-charge ratios of ions appearing in mass spectra.

Mass calibration in prior art GC-HRTOFMS typically involves the following steps:

introducing a calibrant material, such as perfluorokerosene (PFK) or perfluorotributylamine (PFTBA), to the ion source for a period of time;

recording mass spectra of the calibrant material;

determining an empirical relationship between the m/Q ratios of calibrant ions and their measured times of flight;

stopping the introduction of the calibrant into the ion source;

admitting a sample for GC-HRTOFMS analysis; and compensating for temporal drift during the analysis by monitoring a so-called "lock mass" throughout the run.

In stopping the introduction of the calibrant into the ion source during the fourth step of the procedure, calibrant material is removed from the ion source prior to the introduction of the sample, and is not re-introduced to the ion source until the analysis of the sample is completed. It is known that, over the course of a typical GC analysis, thermal drift in the temperature of the HRTOFMS flight tube will cause changes in its length due to thermal expansion or contraction, thereby inducing drift in times-of-flight. To compensate for this effect, it is common to monitor the time-of-flight of a particular ion, that is, of a so-called "lock mass." This permits one parameter in the mathematical relationship between time-of-flight and m/z ratio to be compensated for drift. This procedure is referred to herein as "single-parameter drift compensation."

Temperature change is not the only source of drift in time-of-flight mass spectrometers. To compensate for additional sources of drift it is necessary to monitor more than one "lock mass." Ideally, in fact, one would monitor all ions normally employed for mass calibration, throughout the analytical run. This would permit frequent updating of as many of the mass calibration parameters as there are ions in the calibrant mass spectrum. By repeating such a mass calibration frequently throughout the analytical run, it would be possible to compensate for many possible sources of drift in time-of-flight measurements. Such a procedure is referred to herein as "multi-parameter drift compensation."

One way to achieve multi-parameter drift compensation is to introduce mass calibrant material to the ions source of the HRTOFMS continuously throughout the analytical run, and to perform a large number of mass calibrations during the run. This procedure, however, is disadvantageous for two reasons. First, calibrant ions frequently interfere with analyte ions. Second, calibrant material in the ion source competes for ionizing agents, for example, 70 eV electrons in the case of electron impact ionization, or quasi-molecular ions in the case of chemical ionization. This competition lowers sensitivity. For these reasons, multi-parameter drift compensation is not practical in most analytical systems, especially in GC-HRTOFMS and in GC×GC×HRTOFMS. It would be useful, therefore, to introduce calibrant material during an analytical run, but in a manner that avoids mass interference and sensitivity loss.

SUMMARY

It is an object of the present invention to provide a method that comprises introducing, in pulsed fashion, a mass calibration material ("calibrant") to the ion source of a chromatographic mass spectrometer system, and more particularly to a GC×GC×HRTOFMS, and a system for carrying out such a method.

It is a further object of the present invention to provide a method that comprises synchronizing calibrant pulses with modulation events used in GC×GC, and a system for carrying out such a method.

It is yet another object of the present invention to provide a method that comprises introducing a multiplicity of pulses of calibrant material to the ion source of a mass spectrometer after a sample has been admitted to a chromatograph, but before the sample has passed through the chromatograph, and before the analysis of the sample is complete, and a system for carrying out such a method.

It is still another object of the present invention to provide a method that comprises introducing a multiplicity of pulses of calibrant material to the ion source of a mass spectrometer in such manner as to avoid mass spectral interferences or loss of sensitivity with respect to the sample material, and a system for carrying out such a method.

It is yet another object of the present invention to provide a method that comprises introducing a multiplicity of calibrant pulses to the ion source of a mass spectrometer such that the concentration of the calibrant material in each such pulse rises to an acceptable level, then falls to an acceptable level, during the so-called "dead band" of a GC×GC secondary column, and a system for carrying out such a method.

It is also an object of the present invention to provide a method that effects multi-parameter drift compensation by computing a multiplicity of mass calibration coefficients, and a system for carrying out such a method.

According to various embodiments, a method is provided for calibrating mass-to-charge ratio measurements obtained from a time-of-flight mass spectrometer disposed in series, and in fluid communication with, a chromatograph, as, for example, when a mass spectrometer is used to further analyze the effluent of a gas chromatograph. The method can comprise introducing a calibrant material into a time-of-flight mass spectrometer after a sample is introduced to the chromatographic system, but before the analysis of the sample is complete, such that calibrant material and sample material are not contemporaneously present at the ion source of the mass spectrometer. The method can further comprise acquiring a multiplicity of mass spectra of the calibrant material during an analytical run. In some embodiments, a multiplicity of mass calibrations can be calculated on the basis of mass spectra obtained from the calibrant material introduced during the analytical run.

These and other objects and features of the present teachings will be even further apparent with reference to the disclosure that follows and the accompanying drawings.

BRIEF DESCRIPTION OF THE DRAWINGS

The present teachings can be more fully understood with reference to the appended drawings that are intended to illustrate and exemplify, but not limit, the present teachings.

DETAILED DESCRIPTION

Figure 1:
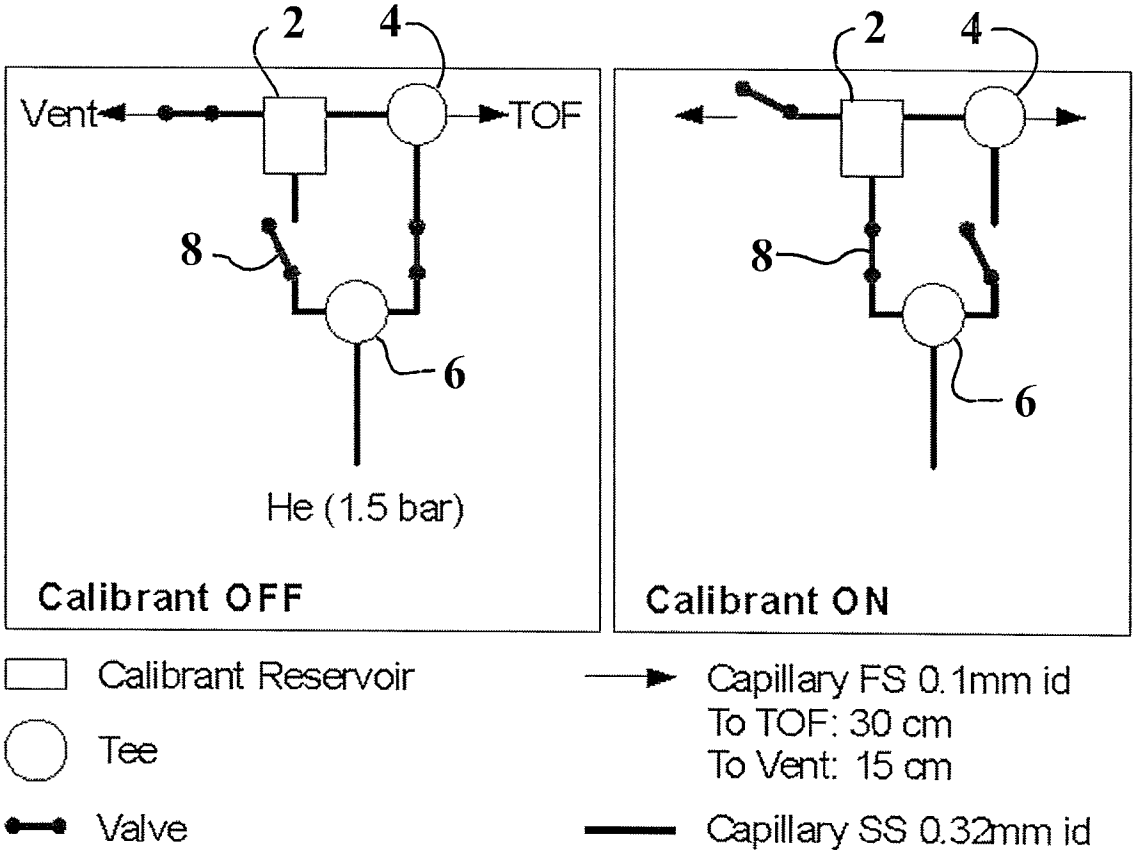
FIG. 1 is a schematic diagram of a pulsed calibrant introduction system according to various embodiments of the present teachings.

According to various embodiments, a method is provided for calibrating mass-to-charge ratio measurements obtained with a mass spectrometer disposed in series, and in fluid communication, with a chromatograph, as, for example, when a mass spectrometer is used to further analyze the effluent of a gas chromatograph. A calibrant material can be introduced into the time-of-flight mass spectrometer after a sample is introduced to the chromatographic system, but before the analysis of the sample is complete. According to the present teachings, the calibrant material and sample material are not contemporaneously present at the ion source of the mass spectrometer. The method can further comprise acquiring a multiplicity of mass spectra of the calibrant material during an analytical run. In some embodiments, a multiplicity of mass calibrations can be calculated on the basis of mass spectra obtained from the calibrant material introduced during the analytical run. A system for carrying out the methods is also provided.

According to various embodiments, the system can comprise a time-of-flight mass spectrometer comprising an ion source, a chromatographic system operationally connected to the time-of-flight mass spectrometer, a source of calibrant material in fluid communication with the time-of-flight mass spectrometer, and a control unit. In some embodiments, the chromatographic system can comprise a comprehensive two-dimensional gas chromatograph, and the method can comprise pulsing the calibrant material into the ion source of the mass spectrometer during a multiplicity of secondary column dead bands. In some embodiments, the method can further comprise compensating for temporal drift, during the analytical run, of at least two mass calibration parameters.

The control unit can be configured to introduce a sample to the chromatographic system and introduce the calibrant material from the source of calibrant material into the time-of-flight mass spectrometer after the sample is introduced to the chromatographic system and before an analysis of the sample is complete. The introduction of the calibrant material can be under conditions such that calibrant material and sample material are not present contemporaneously at the ion source of the time-of-flight mass spectrometer. The control unit can also be configured to acquire a multiplicity of mass spectra of the calibrant material during the analytical run, and to calculate a multiplicity of mass calibrations on the basis of mass spectra obtained from the calibrant material introduced during the analytical run.

In some embodiments, the control unit can comprise and/or be configured to control a source of carrier gas, a first fluid pathway comprising a valve and providing a fluid communication between the source of carrier gas and the source of calibrant material. The control unit can also comprise and/or be configured to control a second fluid pathway comprising a second valve and providing a fluid communication between the source of carrier gas and the time-of-flight mass spectrometer. The control unit can also comprise and/or be configured to control a third fluid pathway providing a fluid communication between the source of calibrant material and the time-of-flight mass spectrometer. The source of carrier gas can comprise a source of helium, hydrogen, nitrogen, or other carrier gas, for example, a source of an inert gas. The source of calibrant material can comprise a source of perfluorokerosene (PFK), perfluorotributylamine (PFTBA), perflouromethyldecaline (PFD), other calibrant material, a combination thereof, or the like. In some embodiments, the chromatographic system can comprise a comprehensive two-dimensional gas chromatograph and the control unit can be configured to pulse calibrant material from the source of calibrant material into the ion source of the mass spectrometer during a multiplicity of secondary column dead bands.

In some embodiments, various features of the present teachings are useful in a GC×GC×HRTOFMS platform. The present teachings can be used with and used by various devices, systems, and methods as described, for example, in the following publications, each of which is incorporated herein by reference in its entirety: U.S. Pat. No. 5,135,549, issued Aug. 4, 1992; U.S. Pat. No. 5,196,039, issued Mar. 23, 1993; European Patent No. 0522150; Japanese Patent Application No. 506281/4, issued as Japanese Patent No. 3320065; U.S. Pat. No. 6,007,602, issued Dec. 28, 1999; U.S. Pat. No. 6,547,852 B2, issued Apr. 15, 2003; International Patent Publication No. WO 01/51170 (PCT/USO1/01065) filed Jan. 12, 2001; PCT Application No. PCT/US02/08488 filed Mar. 19, 2002; Chinese Patent No. ZL 02828596.4, issued Jul. 1, 2009; European Patent Application Number 02725251.9, issued Jul. 9, 2009; Japanese Patent No. 4231793, issued Dec. 12, 2008; and U.S. Pat. No. 7,258,726 B2 issued Aug. 21, 2007.

According to various embodiments, a GC×GC modulation method is provided that produces a series of so-called "secondary chromatograms" lasting, for example, for about 8 seconds each. At the beginning of each secondary gas chromatogram there is a so-called "dead band," comprising a short time interval lasting typically from a few tenths of a second to one or two seconds, during which no analyte material can arrive in the ion source of the mass spectrometer. This dead band is attributable to the fact that analyte molecules can travel through the GC column no faster than the carrier gas flowing through it. Consequently, no analyte material can elute from a GC column before the carrier gas has swept the column volume at least once. This "first sweep" of the column volume by the carrier gas gives rise to the dead band.

In some embodiments, a GC×GC system can be used that acquires several hundred secondary chromatograms, each having a duration of several seconds. Consequently, several hundred secondary column dead bands occur over the course of a typical analysis. According to various embodiments, the system comprises a valve arrangement configured to pulse a calibrant material, such as perfluorokerosene (PFK), perfluorotributylamine (PFTBA), perflouromethyldecaline (PFD), or the like, into the ion source such that the concentration of the calibrant material rises and falls in a period of time smaller than the duration of the dead band. This procedure supplies mass calibration spectra every few seconds thereby enabling frequent mass calibration of the HRTOFMS and enabling multi-parameter drift compensation.

In some embodiments, the present teachings overcome the aforementioned difficulties encountered in conventional systems. According to various embodiments, calibrant material, although introduced to the ion source of the mass spectrometer after the sample has been admitted to the chromatograph and before analysis is complete, is present, if at all, only in insignificant concentrations in the ion source whenever sample material is present. This can be achieved, for example, by synchronizing introduction of the calibrant with the secondary column dead bands. Consequently, neither mass spectral interference nor sensitivity loss occurs to a significant degree.

It should be noted that sample can occasionally appear in the ion source during the secondary column dead time, due to the well-known "wrap-around" effect. In most cases, this effect is rare, and can be eliminated according to the present teachings, for example, through proper tuning of the GC×GC instrument using methods known in the art.

The invention will be better understood with reference to the attached drawings wherein FIG. 1 illustrates an apparatus for introducing a pulse of calibrant material to a vacuum system of a mass spectrometer. The apparatus comprises a calibrant reservoir 2, a Tee connection 4 leading to a time-of-flight mass spectrometer (TOF), a Tee connection 6 leading to valved conduits in communication with calibrant reservoir 2 and Tee connection 4, and a plurality of valves 8. In the "calibrant off" state, simple on/off valves open and close in such a manner so as to establish a flow of carrier gas, for example, helium gas, from Tee connections 6 and 4, sequentially, in communication with the TOF. As shown in FIG. 1, the conduit or tube communicating Tee connection 6 to calibrant reservoir 2 is provided with a valve 8 in a closed (non-communicating) position. The helium flow thus established carries the calibrant material away from the TOF and out a vent. In the "calibrant on" state, the helium flow sweeps the contents of the conduit or tube communicating Tee connection 6 to calibrant reservoir 2 and the conduit or tube is provided with valve 8 in an opened (communicating) position. Also, in the "calibrant on" state, the vent is closed off from the circuit by a valve, as shown, being in a closed (non-communicating) position. By pulsing the valves in synchronicity with the modulation period, the system can deliver calibrant material during the secondary column dead band. In some embodiments, by pulsing the valves in synchronicity with the modulation period, the system can be configured to only deliver calibrant material during the secondary column dead band. In some embodiments, the tubing from Tee connection 4 and/or 6, to the TOF, can be heated. In some embodiments, the Tee connection and the tube connecting the Tee connection to the calibrant reservoir can be heated. In some embodiments, the valves can operate at room temperature.

In some embodiments, the carrier gas can be made to move through a capillary chromatographic column under a pressure of from about 1.1 bar to about 3.0 bar, or from about 1.25 bar to about 1.75 bar, or from about 1.4 bar to about 1.6 bar, or at a pressure of about 1.5 bar.

The capillary can comprise a first stage having an inner diameter (id) of from about 0.05 mm to about 0.2 mm, or from about 0.075 mm to about 0.125 mm, or about 0.1 mm. The capillary can comprise a second stage having an inner diameter of from about 0.1 mm to about 0.5 mm, or from about 0.2 mm to about 0.4 mm, or about 0.32 mm. The distance from the valve-controlled T-connection to the time-of-flight mass spectrometer can be about twice as long as the distance from the T-connection to the vent, for example, about 30 cm versus about 15 cm or about 40 cm versus about 20 cm.

Figure 2:
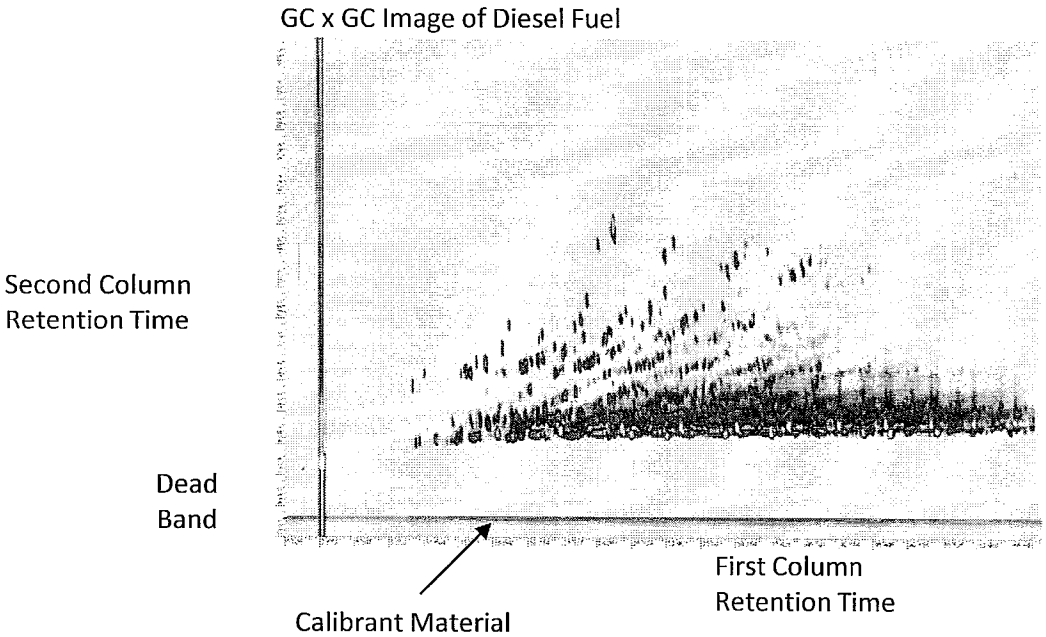
FIG. 2 is a chromatogram resulting from a GC×GC method whereby calibrant material is pulsed into a secondary column dead band, according to various embodiments of the present teachings.

FIG. 2 illustrates pulsed calibrant introduction throughout a GC×GC analysis of diesel fuel. Several hundred calibrant pulses, one per secondary chromatogram, appear to merge into a continuous band along the bottom of the image. It is clear that the calibrant material is confined to the dead band of each secondary column separation (vertical direction). Thus, given a modulation period (vertical image height) of 8 seconds, it is possible to calibrate the mass spectrometer every eight seconds against a full scan spectrum of the calibrant material. Frequent determination of the mass calibration model effectively compensates for long term, that is, over one hour, drift in HRTOFMS calibration parameters.

Figure 3:
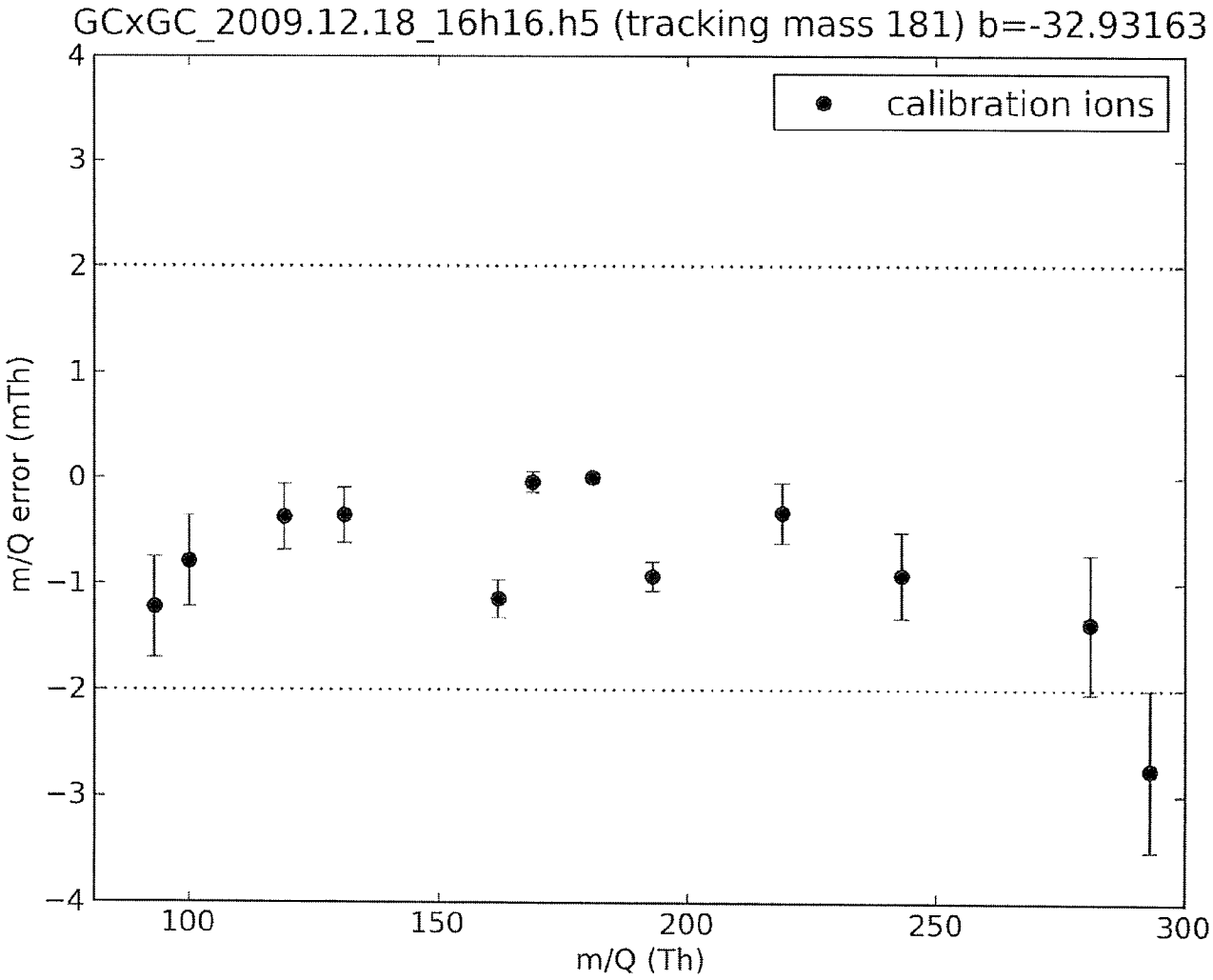
FIG. 3 is a graph illustrating mass measurement errors, also known as "mass measurement residuals," "error residuals," and the like, resulting from single parameter drift compensation.

The relationship between the time-of-flight t and the mass-to-charge ratio M of an ion is given by Equation (1) below:

$$t_i = a\sqrt{M_i} + b \tag{1}$$

in which a and b are constants, and i is an index on the ions used for mass calibration. In some embodiments, a calibrant material which provides many ions of known mass-to-charge ratio is introduced, then Equation (1) is fit to the data array $[t_i, M_i]$. The calibrant material is then removed, and the time-of-flight of a single lock mass is measured throughout the analytical run. The measured times-of-flight are used to correct the constant a for drift. FIG. 3 illustrates a typical result of this single-parameter drift compensation.

When calibrant material is pulsed, however, into the mass spectrometer in the manner described herein, a multiplicity of ions is available for mass calibration every few seconds throughout the analytical run. Such an embodiment enables multi-parameter drift compensation.

Figure 4:
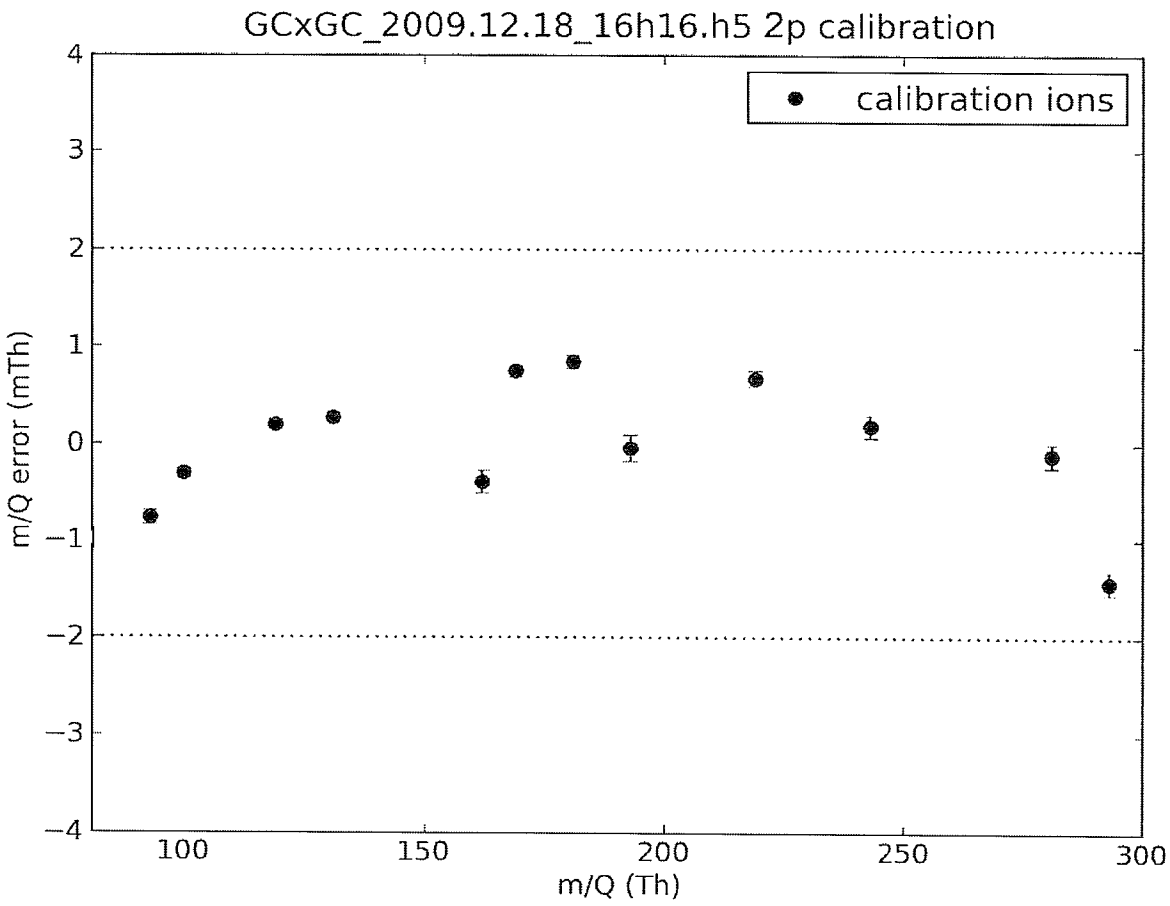
FIG. 4 is a graph illustrating mass calibration error residuals resulting from two-parameter drift compensation, according to various embodiments of the present teachings.

FIG. 4 illustrates a typical result for two-parameter drift compensation according to the present teachings. It is apparent that both the accuracy and the precision of the mass calibration improve, as compared to a single-parameter drift compensation.

After computing best estimates of the constants a and b in Eq. (1), the system can perform a higher order fit to the error residuals, that is, to fit a curve through the array $[\epsilon_i, M_i]$ in which $\epsilon_i$ are errors. A processor, for example, comprising a memory, can be provided as a system component for computing the best estimates and/or applying a quadratic fit to error residuals. The processor and memory can be configured to store and/or display a multiplicity of mass calibrations calculated by the control unit.

Figure 5:
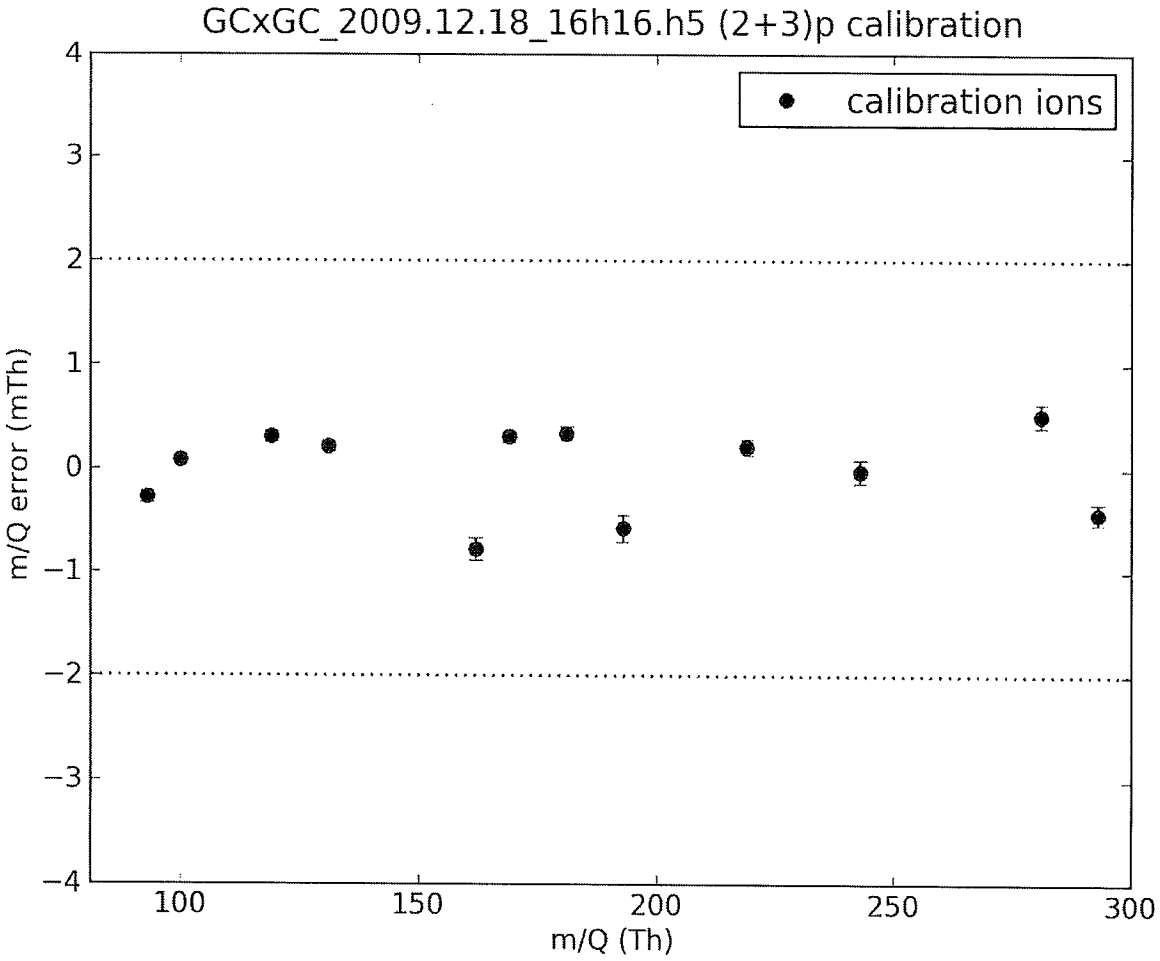
FIG. 5 illustrates mass calibration error residuals resulting from a quadratic fit through residuals obtained from the two-parameter fit, according to various embodiments of the present teachings.

FIG. 5 illustrates the result of a quadratic fit applied to error residuals obtained from a two-parameter fit. It is apparent that the precision does not improve significantly, as compared with the two-parameter fit, whereas the accuracy does improve significantly. The fact that mass measurement precision observed with a two-parameter fit is markedly improved over that of a single-parameter fit, indicates that at least two physical parameters drift during an analytical run. The relatively poor precision of the single-parameter fit is caused by uncompensated drift in the fit parameter a. The fact that fitting error residuals to a parabola has rather little effect on precision, suggests that the higher order fit parameters involved in the parabolic fit are stable throughout the analytical run. This is borne out by plots of the various fit parameters, each as a function of time.

Figure 6:
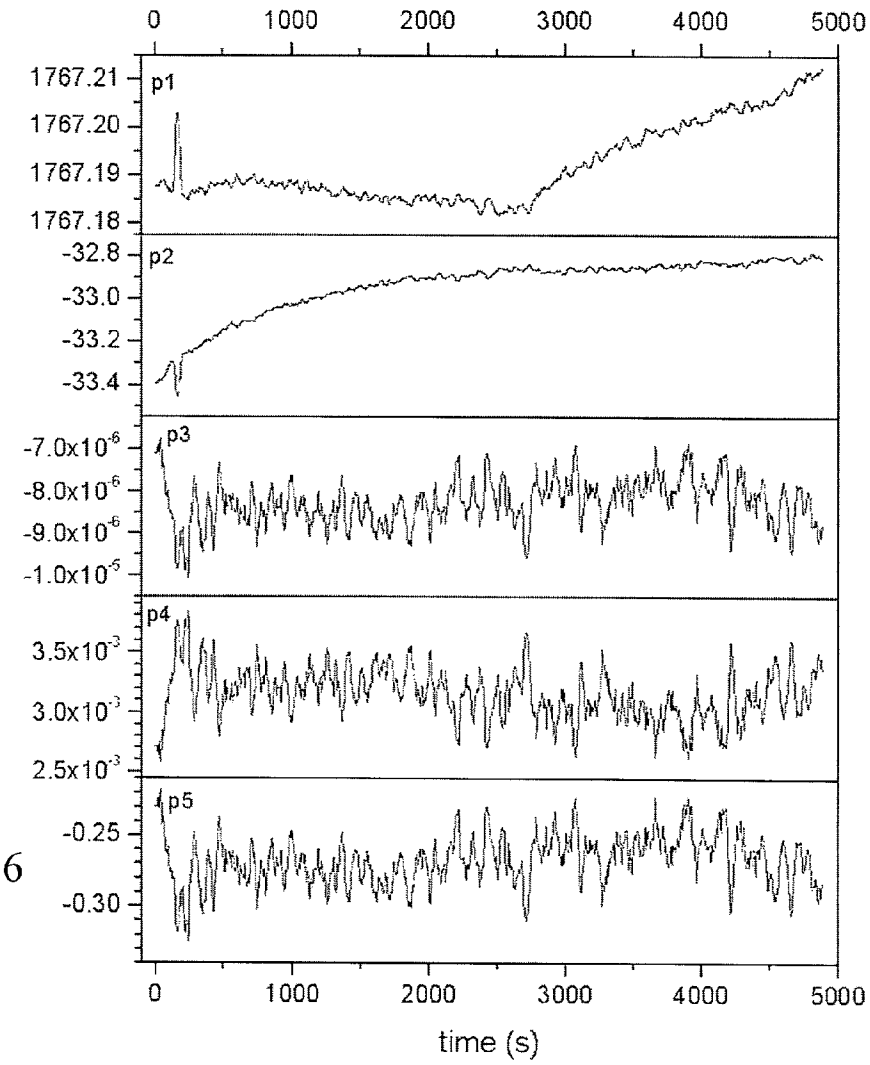
FIG. 6 is a set of graphs of five drift parameters, each taken as a function of time, and which can be compensated for according to various embodiments of the present teachings.

FIG. 6 illustrates plots of drift parameters as functions of time. Parameters p1 and p2 shown in FIG. 6 correspond to parameters b and a, respectively, in Equation (1). Parameters p3, p4, and p5 shown in FIG. 6 are quadratic fit parameters through error residuals obtained from a two-parameter fit. In FIG. 6, it is apparent that only parameters a and b of Equation (1) drift significantly during the particular experiment described.

Figure 7:
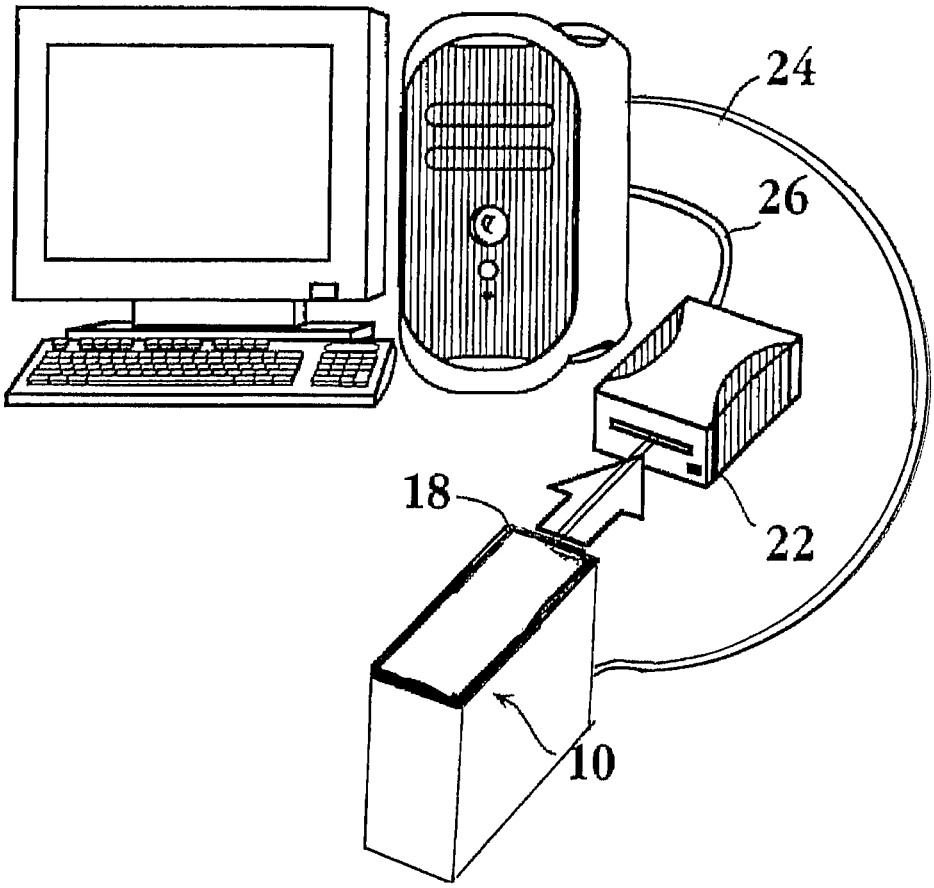
FIG. 7 shows an exemplary system comprising a two-dimensional gas chromatograph, a time-of-flight mass spectrometer, and a control unit comprising a processor and a display, according to various embodiments of the present teachings.

According to various embodiments of the present teachings, and with reference to the exemplary system of FIG. 7, the system can comprise a chromatographic system 10, for example, that includes a two-dimensional gas chromatograph 18 and an apparatus as shown in FIG. 1. Two-dimensional gas chromatograph 18 and the apparatus shown in FIG. 1 can together be housed in a housing, or they can be separately located. Sample and calibrant can be fed from chromatographic system 10 into a mass spectrometer 22, for example, a time-of-flight mass spectrometer, for analysis. Mass spectrometer 22 can be configured, through electrical signal-carrying cable 26, for communication with a control unit, for example, a computing device such as a processor as shown. A display and keyboard can also be provided for programming, data entry, and/or to display results, calibrations, chromatograms, and the like. Chromatographic system 10 can be configured, through electrical signal-carrying cable 24, for communication with the control unit. Cables 24 and 26 can comprise a USB cable, a FireWire cable, a CAT5 cable, or the like. The control unit can comprise a memory that can be written to before, during and/or after analysis.

In one arrangement, programs are installed on the computing portion of the control unit, which can collect and analyze data produced by the chromatographic systems and by the mass spectrometer. A data collection program ("Data Collection") can be provided to process information as it is generated and plots different signals over time during an analytical run. After each run is finished, the Data Collection program can launch an Analysis program. The Analysis program can integrate raw data, normalize aspects of the data, enhance data and/or signals, and use the information to determine the parameters for posting results. The analyzed data can be re-plotted together as a series of peaks, clusters, or dots representing different chemical species (for example, a chromatogram). The results can be stored in a Sample File, which includes the raw data, the chromatogram, mass spectrometry data, and file information entered by a user. Any of the files can be written to a memory region of the control unit.

It should be appreciated that the memory can store a variety of types of information, including software applications and/or operation instructions that can be loaded to, and executed by, a computing device, such as a computing capable processing station or a desktop computer. In embodiments employing a rewritable storage medium, the stored information can reflect, for example, changes in, or processing steps performed on, one or more samples; sample lineage; sample logging; location management; or the like.

Figure 8:
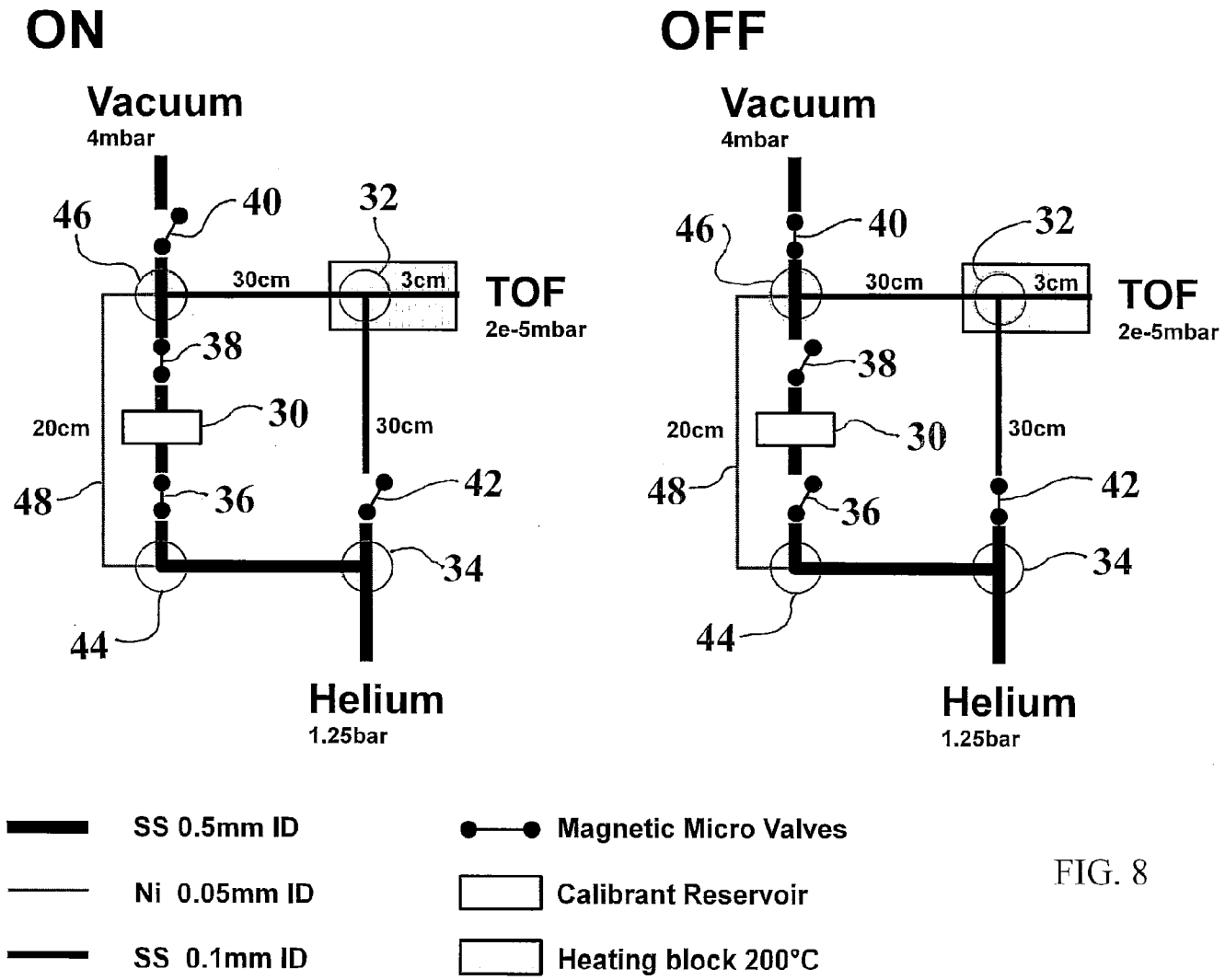
FIG. 8 is a schematic diagram of a pulsed calibrant introduction system according to yet other various embodiments of the present teachings.

FIG. 8 shows yet another embodiment of the present teachings. As mass spectrometers can be very sensitive, a steady-state background level of calibrant material can result from any leakage of valves, even from very slight leakage. To obviate this problem in systems comprising leaky valves, a valve and back-flush scheme according to the present teachings and as shown in FIG. 8 can be used. As shown, the system comprises a calibrant reservoir 30, a Tee connection 32 leading to a time-of-flight mass spectrometer (TOF), a Tee connection 34 leading to valved conduits in communication with calibrant reservoir 30 and Tee connection 32, a plurality of valves 36, 38, 40, and 42, Tee connections 44 and 46, and a back-flush line 48. As can be seen, Tee connection 32 can be mounted on, in, or adjacent a heating block, for example, a heating block configured to be heated to about 200° C. Valves 36, 38, 40, and 42 can each independently comprise a magnetic micro valve. The conduits or tubing of the system can comprise glass, plastic, or metal, for example, stainless steel (SS), nickel (Ni), aluminum, or the like.

As can be seen, the inner diameter of back-flush line 48 can be less than the inner diameter of the conduits leading to and communicating with the TOF, for example, 90% or less of the larger inner diameter, 75% or less of the larger inner diameter, 60% or less of the larger inner diameter, or 50% or less of the larger inner diameter. The inner diameter of back-flush line 48 can be less than the inner diameter of the conduits leading to and away from calibrant reservoir 30, for example, 50% or less of the larger inner diameter, 40% or less of the larger inner diameter, 30% or less of the larger inner diameter, or 10% or less of the larger inner diameter.

In the calibrant "ON" state shown in FIG. 8, the helium flow sweeps the contents of the conduit or tube communicating Tee connection 34 to calibrant reservoir 30 and the conduit or tube is provided with valves 36 and 38 in opened (communicating) positions while valves 40 and 42 are in closed (non-communicating) positions. In the calibrant "ON" state, the vent or vacuum source (herein, "Vacuum") is closed off from the circuit by valve 40 being in a closed (non-communicating) position.

In the calibrant "OFF" state shown in FIG. 8, valves 36 and 38 are in closed (non-communicating) positions while valves 40 and 42 are in opened (communicating) positions. The valves can open and close in such a manner so as to establish a flow of carrier gas, for example, helium gas, from Tee connections 34 and 32, sequentially, in communication with the TOF.

As shown in FIG. 8, back-flush line 48 can be about 20 cm long in the exemplary system shown, and can have an inner diameter of 50 microns. With valves 36 and 38 closed as in the OFF position, as depicted in the right-hand side of the drawing, back-flush line 48 sets up a reverse flow through all the conduits (capillaries or tubing) that had communicated with calibrant reservoir 30 during the calibrant "ON" state. This reverse flow, or "back-flush," sweeps residual and/or leaking calibrant away from Tee connection 32 communicating with the TOF. The helium flow thus established carries the calibrant material away from the TOF and out a vent. As a result, steady state background due to the presence of calibrant can be suppressed or eliminated and calibrant pulses can be much sharper, decaying to insignificant levels within about 0.3 seconds or less from the moment the valves switch to change the system from the calibrant "ON" state to the calibrant "OFF" state. The operation of this pulser system enables a calibrant pulse to rise and fall within a single secondary column dead band. By pulsing the valves in synchronicity with the modulation period, the system can deliver calibrant material during the secondary column dead band. In some embodiments, by pulsing the valves in synchronicity with the modulation period, the system can be configured to only deliver calibrant material during the secondary column dead band.

In some embodiments, the tubing from Tee connections 34 and/or 36, to the TOF, can be heated. In some embodiments, Tee connections 44 and/or 46, and the conduits leading to and away from calibrant reservoir 30 can be heated. In some embodiments, all valves can operate at room temperature.

It is apparent, therefore, that the procedure of admitting a calibrant material to a time-of-flight mass spectrometer in a manner that does not create mass spectral interferences with sample material, enables frequent mass calibration of the mass spectrometer. Frequent mass calibrations, in turn, compensate for temporal drift in at least two mass calibration parameters, thereby improving both the accuracy and precision of mass-to-charge ratio measurements throughout the analytical run.

Other embodiments of the present teachings will be apparent to those skilled in the art from consideration of the present specification and practice of the present teachings disclosed herein. It is intended that the present specification and examples be considered exemplary only and not limiting.

What is claimed:

1. A method of calibrating mass-to-charge ratio measurements obtained from a mass spectrometer disposed in series, and in fluid communication with, a chromatographic system, the method comprising:

i) introducing a calibrant material into a mass spectrometer during an analytical run, the mass spectrometer comprising an ion source and the introducing occurring after a sample is introduced to a chromatographic system for the analytical run but before analysis of the sample is complete, the introducing being carried out such that calibrant material and sample material are substantially not present contemporaneously at the ion source of the mass spectrometer;

ii) acquiring a multiplicity of mass spectra of the calibrant material during the analytical run; and iii) calculating a multiplicity of mass calibrations on the basis of mass spectra obtained from the calibrant material introduced during the analytical run.

2. The method of claim 1, wherein the chromatographic system comprises a comprehensive two-dimensional gas chromatograph, and the calibrant material is pulsed into the ion source of the mass spectrometer during a multiplicity of secondary column dead bands.

3. The method of claim 1, wherein the chromatographic system comprises a gas chromatograph and the method comprises delivering the calibrant material into the mass spectrometer by using a carrier gas flow.

4. The method of claim 1, further comprising compensating for temporal drift, during the analytical run, of at least two mass calibration parameters.

5. The method of claim 1, wherein the calibrant material is pulsed into the ion source.

6. The method of claim 1, wherein the introducing comprises injecting the calibrant material into a helium gas flow.

7. The method of claim 1, wherein the mass spectrometer comprises a time-of-flight mass spectrometer.

8. The method of claim 1, further comprising:

chromatographically separating a sample into a plurality of sample bands flowing through a gas chromatographic column;

flowing the plurality of sample bands from the chromatographic column to the mass spectrometer; and introducing the plurality of sample bands, one at a time, into the mass spectrometer as part of the analytical run, wherein the introducing of the calibrant occurs between the introducing of at least two sample bands of the plurality of sample bands, and the calibrant material and the sample bands are substantially not present contemporaneously at the ion source.

9. A system comprising:

a time-of-flight mass spectrometer comprising an ion source;

a chromatographic system operationally connected to the time-of-flight mass spectrometer;

a source of calibrant material in interruptable fluid communication with the time-of-flight mass spectrometer; and a control unit configured to introduce a sample to the chromatographic system, introduce the calibrant material from the source of calibrant material into the time-of-flight mass spectrometer after the sample is introduced to the chromatographic system and before an analysis of the sample is complete, wherein the introduction of the calibrant material is such that calibrant material and sample material are not present contemporaneously at the ion source of the time-of-flight mass spectrometer, acquire a multiplicity of mass spectra of the calibrant material during the analytical run, and calculate a multiplicity of mass calibrations on the basis of mass spectra obtained from the calibrant material introduced during the analytical run.

10. The system of claim 9, wherein the control unit comprises:

a source of carrier gas;

a first fluid pathway comprising a valve and providing a fluid communication between the source of carrier gas and the source of calibrant material;

a second fluid pathway comprising a valve and providing a fluid communication between the source of carrier gas and the time-of-flight mass spectrometer; and a third fluid pathway comprising providing a fluid communication between the source of calibrant material and the time-of-flight mass spectrometer.

11. The system of claim 10, wherein the source of carrier gas comprises a source of helium gas.

12. The system of claim 10, wherein the source of carrier gas comprises a source of hydrogen gas.

13. The system of claim 9, wherein the source of calibrant material comprises a source of perfluorokerosene (PFK), perfluorotributylamine (PFTBA), perflouromethyldecaline (PFD), or a combination thereof.

14. The system of claim 9, wherein the chromatographic system comprises a comprehensive two-dimensional gas chromatograph, and the control unit is configured to pulse calibrant material from the source of calibrant material into the ion source of the mass spectrometer during a multiplicity of secondary column dead bands.

15. The system of claim 9, further comprising a source of sample operationally connected to the chromatographic system.

16. The system of claim 9, further comprising a source of carrier gas operationally connected to the chromatographic system.

17. The system of claim 9, further comprising a processor having a memory and configured to store and display a multiplicity of mass calibrations calculated by the control unit.

* * * * *